US007737844B2

(12) United States Patent
Scott et al.

(10) Patent No.: US 7,737,844 B2
(45) **Date of Patent: *Jun. 15, 2010**

(54) PROGRAMMING STATION FOR A SECURITY SYSTEM FOR PROTECTING MERCHANDISE

(75) Inventors: Ian R. Scott, Duluth, GA (US); Christopher J. Fawcett, Charlotte, NC (US); Ronald M. Marsilio, Lake Wiley, SC (US)

(73) Assignee: Invue Security Products Inc., Charlotte, NC (US)

( * ) Notice: Subject to any disclaimer, the term of this patent is extended or adjusted under 35 U.S.C. 154(b) by 501 days.

This patent is subject to a terminal disclaimer.

(21) Appl. No.: 11/638,814

(22) Filed: Dec. 14, 2006

(65) Prior Publication Data

US 2007/0144224 A1 Jun. 28, 2007

Related U.S. Application Data

(60) Provisional application No. 60/753,861, filed on Dec. 23, 2005.

(51) Int. Cl.
*G08B 13/14* (2006.01)

(52) U.S. Cl. ..... 340/568.2; 340/5.25; 340/693.5; 340/815.45

(58) Field of Classification Search ..... 340/568.2, 340/568.1, 568.8, 572.1, 693.5, 691.1, 815.45, 340/5.25

See application file for complete search history.

(56) References Cited

U.S. PATENT DOCUMENTS

| | | | | |
|---|---|---|---|---|
| 3,493,955 A | | 2/1970 | Minasy | |
| 4,573,042 A | | 2/1986 | Boyd et al. | |
| 4,686,513 A | | 8/1987 | Farrar et al. | |
| 4,800,369 A | | 1/1989 | Gomi et al. | |
| 4,851,815 A | | 7/1989 | Enkelmann | |
| 4,853,692 A | | 8/1989 | Wolk et al. | |
| 4,926,665 A | * | 5/1990 | Stapley et al. | 70/277 |
| 4,980,671 A | | 12/1990 | McCurdy | |
| 5,005,125 A | | 4/1991 | Farrar et al. | |
| 5,182,543 A | | 1/1993 | Siegel et al. | |
| 5,245,317 A | | 9/1993 | Chidley et al. | |
| 5,367,289 A | | 11/1994 | Baro et al. | |
| 5,570,080 A | | 10/1996 | Inoue et al. | |
| 5,589,819 A | | 12/1996 | Takeda | |
| 5,610,587 A | | 3/1997 | Fujiuchi et al. | |
| 5,640,144 A | | 6/1997 | Russo et al. | |

(Continued)

FOREIGN PATENT DOCUMENTS

| | | |
|---|---|---|
| JP | 8279082 | 10/1996 |

*Primary Examiner*—Thomas J Mullen
(74) *Attorney, Agent, or Firm*—Christopher C. Dremann, P.C.

(57) ABSTRACT

A programming apparatus for generating and retaining a security disarm code (SDC) for use in a security system for protecting items of merchandise has a housing and a logic control circuit located within the housing. The control circuit includes a controller for generating the SDC, a memory for storing the generated SDC and a wireless communication system for interfacing with a programmable key used for operating a security device attached to an item of merchandise. A visual display includes a plurality of LEDs which indicate the status of the logic control circuit. The SDC is generated initially as a random SDC by the programming apparatus, which SDC is retained in the controller of the apparatus for the life of the programming apparatus.

19 Claims, 8 Drawing Sheets

U.S. PATENT DOCUMENTS 5,656,998 A 8/1997 Fujiuchi et al.
5,701,828 A * 12/1997 Benore et al. ..... 70/278.2
5,764,147 A 6/1998 Sasagawa et al.
5,767,773 A 6/1998 Fujiuchi et al.
5,793,290 A 8/1998 Eagleson et al.
5,808,548 A 9/1998 Sasagawa et al.
5,838,234 A 11/1998 Roulleaux-Robin
5,864,290 A 1/1999 Toyomi et al.
5,942,978 A 8/1999 Shafer
5,955,951 A 9/1999 Wischerop et al.
5,982,283 A 11/1999 Matsudaira et al.
6,020,819 A 2/2000 Fujiuchi et al.
6,037,879 A 3/2000 Tuttle
6,043,744 A 3/2000 Matsudaira
6,104,285 A 8/2000 Stobbe
6,118,367 A 9/2000 Ishii
6,137,414 A 10/2000 Federman
6,144,299 A 11/2000 Cole
6,255,951 B1 7/2001 De La Huerga
6,304,181 B1 10/2001 Matsudaira
6,346,886 B1 2/2002 De La Huerga
6,384,711 B1 * 5/2002 Cregger et al. ..... 340/5.65
6,420,971 B1 7/2002 Leck et al.
6,433,689 B1 8/2002 Hovind et al.
6,474,117 B2 11/2002 Okuno
6,512,457 B2 1/2003 Irizarry et al.
6,531,961 B2 3/2003 Matsudaira
6,535,130 B2 3/2003 Nguyen et al.
6,677,852 B1 1/2004 Landt
6,961,000 B2 11/2005 Chung
7,102,509 B1 9/2006 Anders et al.
2002/0024440 A1 2/2002 Okuno
2002/0185397 A1 12/2002 Sedon et al.

* cited by examiner

SDC – Secure Disarming Code
MFG – Manufacturing
SW – Switch
CFG – Configuration
Comm I/F – Communications Interface
EAS – Electronic Article Surveillance
AU – Alarm Unit
PS – Programming Station
EOL – End of Life
INIT – Initialize
NP – Not Programmed
ACT SW – Activation Switch
NON-VOL – Non-Volatile
B&F – Beep and Flash
A&F – Alarming and Flashing
SN – Sense

PROGRAMMING STATION FOR A SECURITY SYSTEM FOR PROTECTING MERCHANDISE

CROSS REFERENCE TO RELATED APPLICATIONS

This application claims priority from U.S. Provisional Application Ser. No. 60/753,861 filed Dec. 23, 2005; the disclosure of which is incorporated herein by reference.

BACKGROUND OF THE INVENTION

1. Technical Field

The invention relates to security devices, systems and methods for protection of merchandise, and in particular, to a programming station for use in a security system wherein a smart key is programmed with a security disarm code (SDC) at the programming station by wireless communication, which is subsequently used to program the SDC code into various security devices adapted to be attached to items of merchandise.

2. Background Information

Various retail establishments use numerous types of theft deterrent devices and systems to discourage shoplifters. Many of these systems use various types of alarm modules or other security devices which are attached to the article to be protected in one manner or another. When the integrity of the attached security device or the item of merchandise protected thereby is compromised in any manner, such as cutting the attachment cables which attach the security device to the item of merchandise, removing the merchandise from the security device or disturbing the security device, will cause an audible alarm to be sounded in the security device to alert store personnel that the item of merchandise or security device is being tampered with illegally. These security devices, as well as the items of merchandise protected thereby, also may contain various electronic article surveillance tags (EAS) which will sound an alarm at a security gate upon passing through the gate in an unauthorized manner.

These security devices which are attached to the items of merchandise usually have some type of key, either mechanical or magnetic, which is used to unlock the device from the protected item of merchandise to enable the merchandise to be taken to a checkout counter, as well as to disarm an alarm contained in the security device. One problem with such security systems is that these keys will be stolen from the retail establishment and used at the same establishment or at another store using the same type of security device, to enable a thief to disarm the security device as well as unlock it from the protected merchandise. These keys also are stolen by dishonest employees for subsequent unauthorized use by the employee or sale to a thief for use at the same store or at other stores which use the same security devices controlled by the key.

It is extremely difficult to prevent the theft of these keys by dishonest employees or even by a thief within the retail establishment due to the number of keys that must be available and used by the various clerks in the various departments of the store to facilitate the use of the numerous security devices that are needed to protect the numerous items of merchandise.

Thus, the need exists for a security system which uses various types of security devices which are attached to the items of merchandise, which will prevent a thief or dishonest employee from using a key to disarm and unlock the security device in an unauthorized manner at various retail establishments including the store from which the key was stolen, by programming a security disarm code (SDC) which is unique to a particular store, into the key, by a programming station.

BRIEF SUMMARY OF THE INVENTION

One aspect of the present invention is to provide a security system for protecting items of merchandise, and in particular a programming station which is provided with an internal controller which randomly generates a SDC which remains with the programming station throughout its life, which SDC is subsequently programmed into a smart key used for disarming and unlocking the various security devices from merchandise. The SDC is unique to a particular retail establishment thereby preventing the key from being used at a different store than that from which the key is stolen.

A further aspect of the present invention is to use the programming station in which the SDC is programmed, to program each of the individual security devices with the same SDC when the security devices are first activated by use of a smart key, wherein the SDC remains with the security devices throughout their use in the particular retail establishment for subsequent matching with the SDC stored in the smart key.

A further feature of the present invention is to use the programming station to reprogram the SDC into the smart keys, which keys must be reprogrammed with the SDC after a preset time period. This reprogramming of the smart keys can be performed by authorized personnel in a secure environment insuring that the programming station can be used only by authorized personnel, and only in the store having the programming station, wherein a single SDC is used for all of the security devices in the store.

Still another aspect of the present invention is to provide the programming station with a wireless communication circuit for transferring the generated SDC into the smart keys when initially programming the keys and for each subsequent reprogramming of the keys with the same SDC.

Still another aspect of the invention is to provide the programming station with a plurality of visual indicators which are operatively connected to an internal logic control circuit and are illuminated and/or pulsed to indicate the status of the programming station.

A further feature is to provide the programming station with a wireless communication circuit such as infrared (IR) or radio frequency (RF), for programming the SDC into a smart key; and in which the housing shell component of the programming station is formed of an infrared clear plastic material to enhance the transmission and reception of IR waves when the wireless communication is an IR circuit.

Another aspect of the present invention is that should a smart key having a SDC programmed therein which does not match the SDC stored in the programming station, be used in the programming station, the programming station will immediately time-out the SDC programmed into the key. This prevents a thief which takes a programmed key from one store attempting to use it on a programming station of another store.

These features are obtained by the programming station of the present invention which is intended for use in a security system for protecting items of merchandise, the general nature of which may be stated as comprising a housing; a logic control circuit located within the housing, said control circuit including a controller for generating an SDC, a memory for storing the generated SDC, a wireless communication system for interfacing with a programmable key used for operating a security device attached to an item of merchandise, and a visual display for indicating the status of the logic control circuit.

BRIEF DESCRIPTION OF THE SEVERAL VIEWS OF THE DRAWINGS

A preferred embodiment of the invention, illustrated of the best mode in which Applicant contemplates applying the principles, is set forth in the following description and is shown in the drawings and is particularly and distinctly pointed out and set forth in the appended claims.

Similar numbers refer to similar parts throughout the drawings.

DETAILED DESCRIPTION OF THE INVENTION

Figure 1:
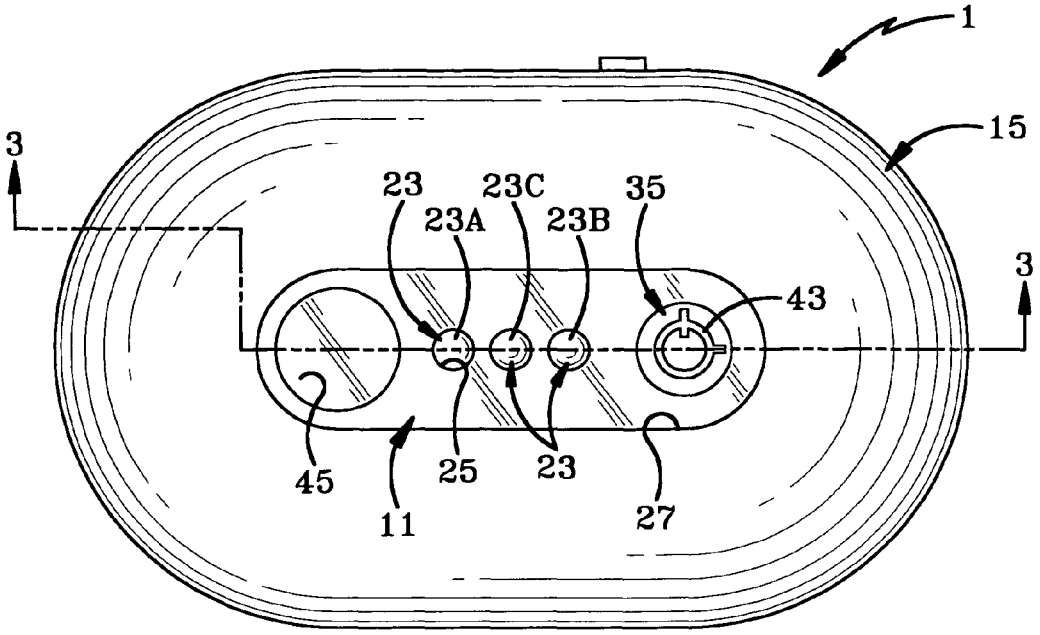
FIG. 1 is a top plan view of the programming station of the present invention.
Figure 2:
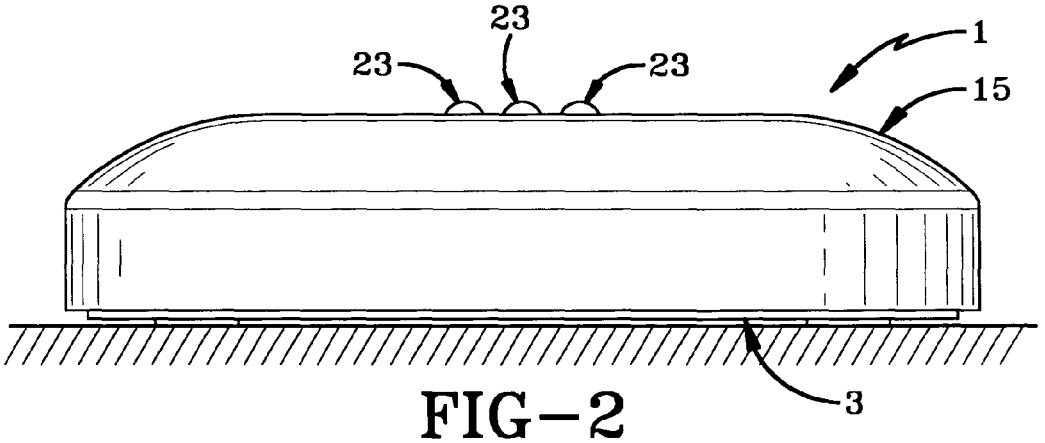
FIG. 2 is a side elevational view of FIG. 1.

The programming station of the present invention is indicated generally at 1, and is shown in particular in FIGS. 1-3A. Programming station 1 includes as its main components, a base plate 3 on which is mounted a printed circuit board 5, which contains a logic control circuit indicated generally at 7, that is shown in detail in FIGS. 4 and 6. A spacer 9 is mounted on base plate 3 for holding various components as described further below. A dome-shaped housing shell 11 is mounted over spacer 9 on base plate 3 and forms an internal chamber 13 in which is located spacer 9, circuit board 5 and other components of the programming station. A housing cover 15 is mounted over housing shell 11 and is secured thereto by a snap-fit engagement. The various housing components, namely, base plate 3, spacer 9, housing shell 11 and housing cover 15 preferably are formed of a rigid plastic material. Shell 11 preferably is formed of an infrared clear plastic material to enhance the transmission of infrared waves.

Figure 3:
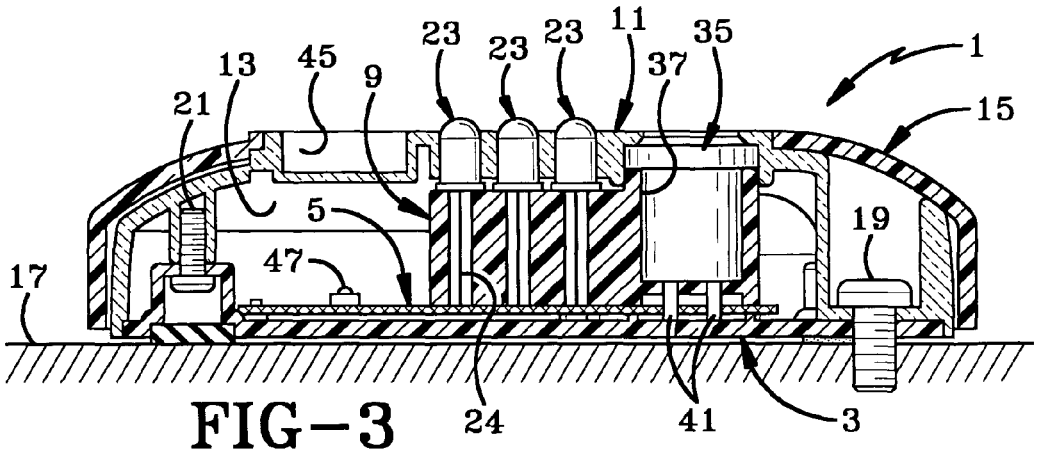
FIG. 3 is a sectional view taken along line 3-3, FIG. 1.
Figure 3A:
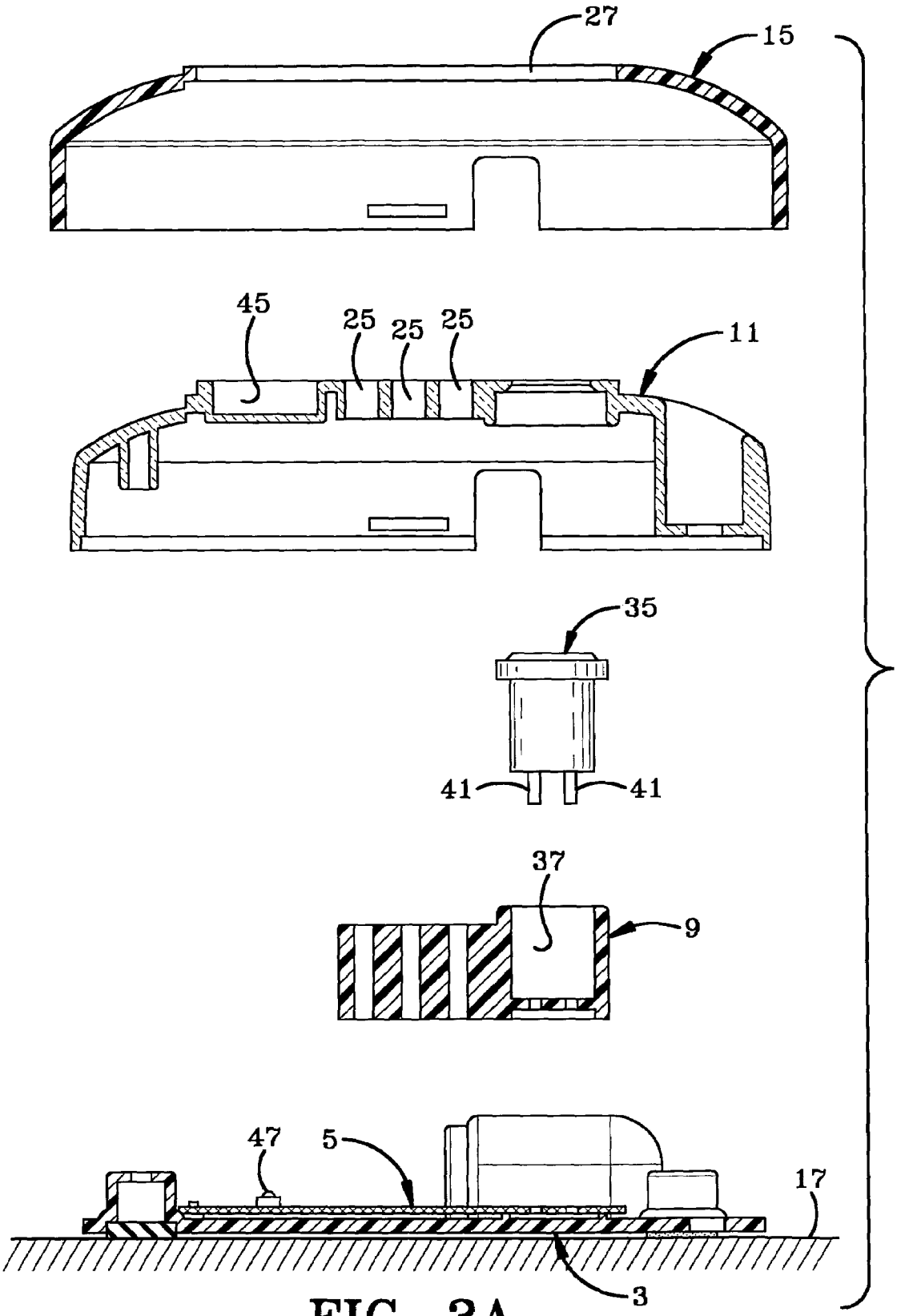
FIG. 3A is an exploded sectional view of the main structural components forming the programming station.

As shown in FIG. 3, programming station 1 can be secured to a supporting structure 17 by bolts or screws 19 in a secure location such as in the store manager's office to prevent possible theft of the programming station. After securing base 3 and shell 11 to structure 17 by fasteners 19, cover 15 can be easily snap-fitted onto shell 11. Base plate 3 is secured to housing shell 11 by a plurality of fasteners 21, only one of which is shown in FIG. 3.

Programming station 1 includes a status display feature which preferably consists of three LEDs 23 which are mounted on spacer 9 and electrically connected to circuit board 5 by conductors 24. LEDs 23 extend through openings 25 formed in the top of housing shell 11, which in turn extends through an oval-shaped opening 27 formed in housing cover 15 (FIGS. 1 and 3). LEDs 23 provide a visual indication of the status of the programming station during operation as discussed further below.

Figure 6:
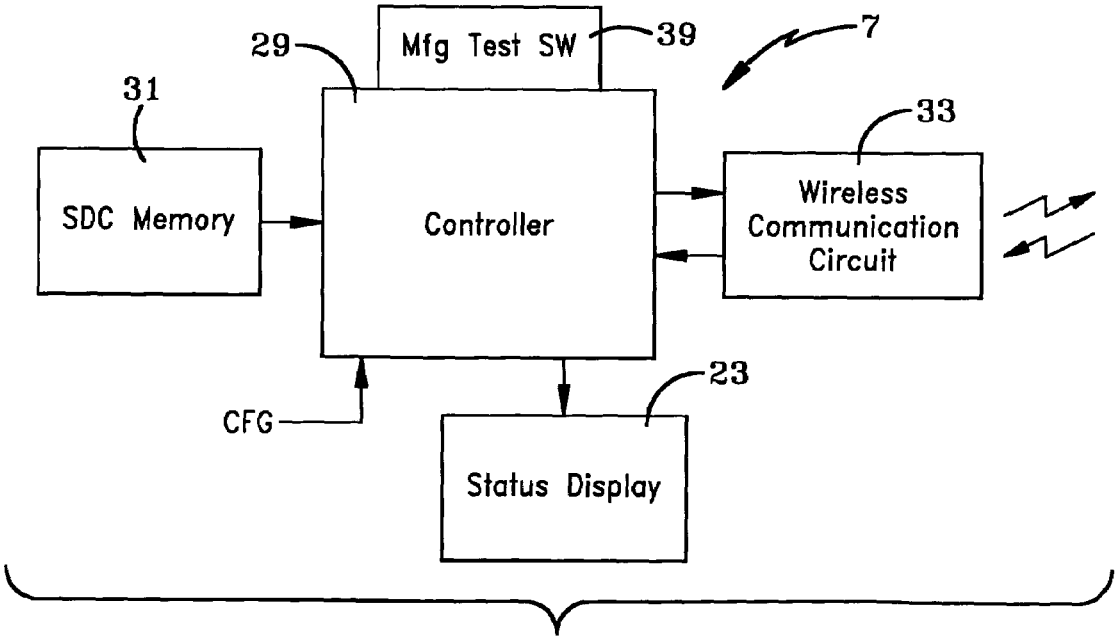
FIG. 6 is a block diagram of the logic control circuit of the programming station.

As shown particularly in FIG. 6, control logic circuit 7 includes a main controller 29 which preferably is a type of microprocessor, an SDC memory 31, and a wireless communication circuit 33. Wireless communication circuit 33 preferably is an infrared (IR) circuit, but could be a radio frequency (RF) type of communication circuit or other types of wireless communication circuits without affecting the concept of the invention. A manufacturing test switch 39 is connected to controller 29 and will be used only after the unit has been manufactured to test the integrity of the logic control circuit, and will not be used once the programming station has been installed into a retail establishment. The status display box indicated in FIG. 6 is the three LEDs 23 discussed above.

A key controlled power on/off switch 35 is mounted in a complementary-shaped opening 37 formed in spacer 9 and is electrically coupled to printed circuit board 5 through depending tabs 41. The exposed top part of key switch 35 is formed with a key receiving opening 43 requiring a specially configured key 38 (FIG. 8) to be used for turning the programming station on and off in order to program a smart key 40 with a security disarm code (SDC) as discussed below. A smart key receiving programming port 45 is formed as a circular recess in housing shell 11 for receiving the transmitting end of key 40 therein, which when inserted therein aligns with the wireless communication components 47 located below on circuit board 5.

Figure 4:
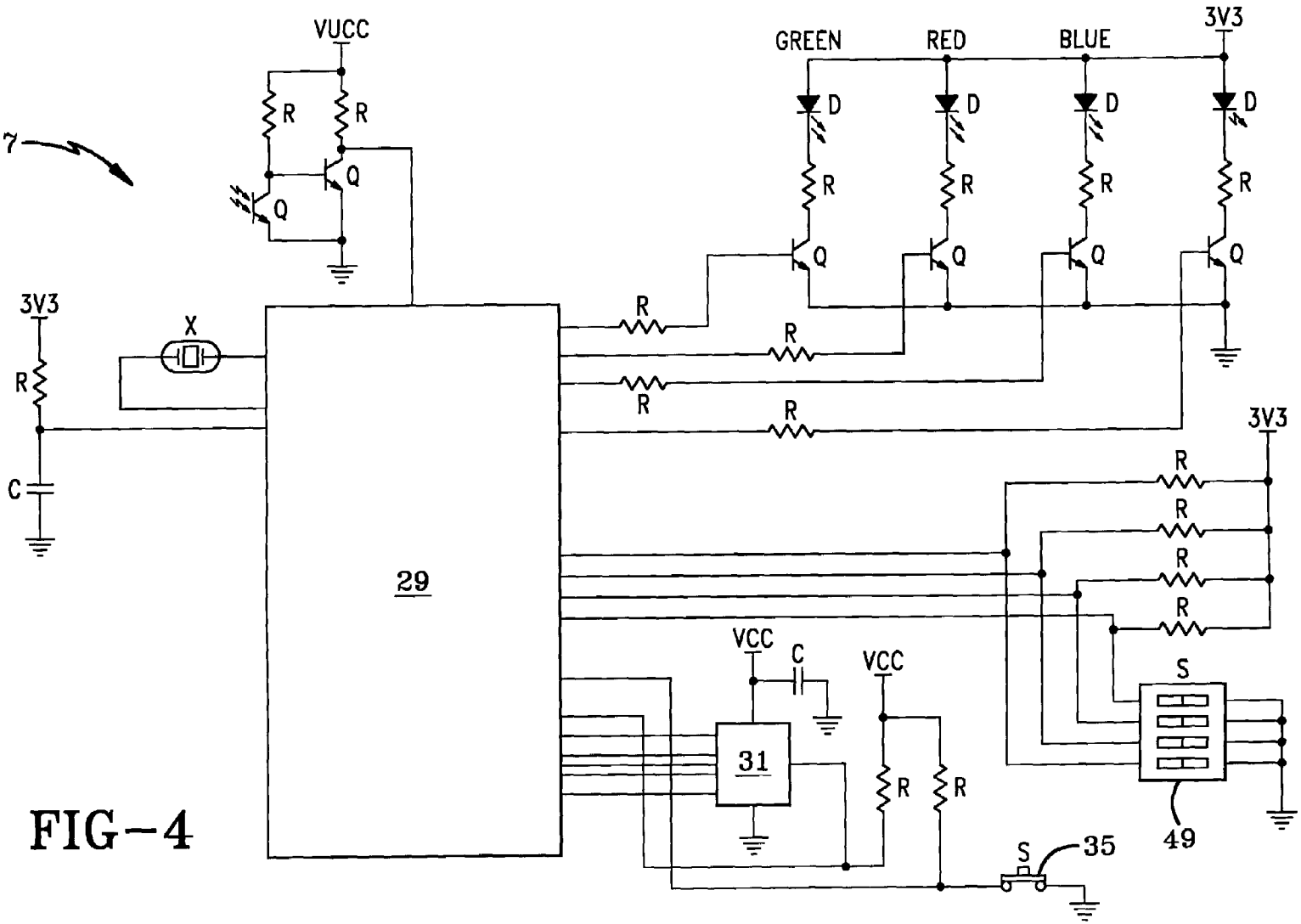
FIG. 4 is the electrical circuit schematic of the logic control circuit of the programming station of the present invention.
Figure 5:
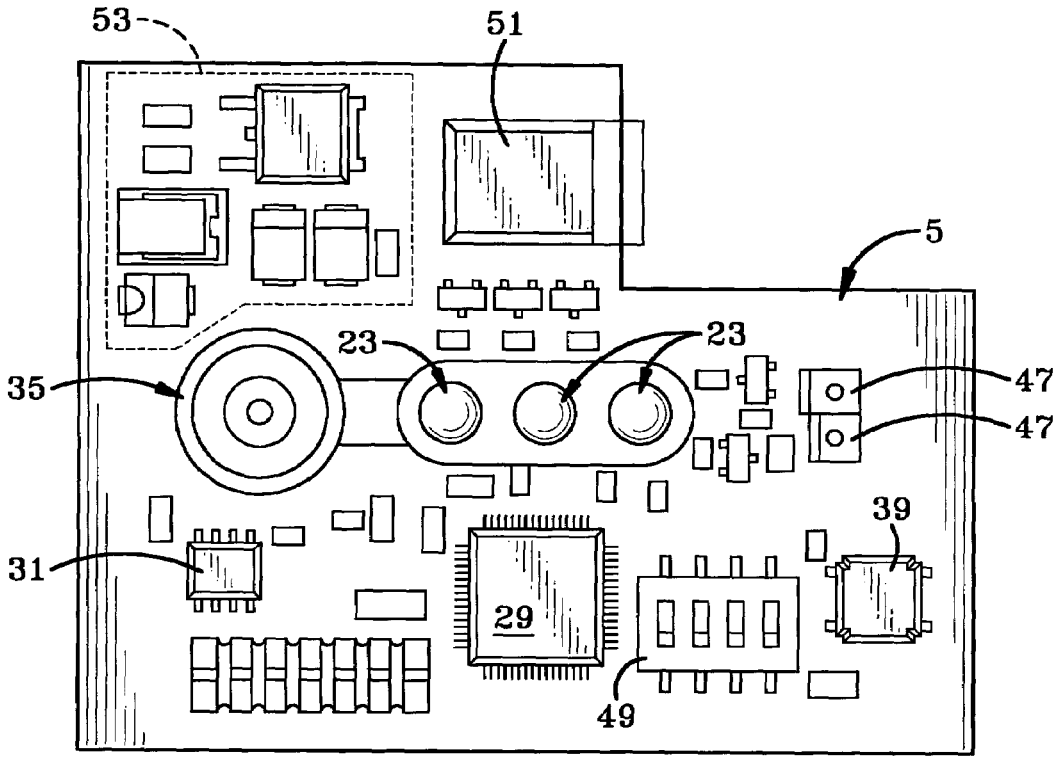
FIG. 5 is a top plan view of the circuit board of the programming station.

The particular details and construction of the logic control circuit can vary from that shown in the drawings and described below without affecting the main concept of the invention. The preferred embodiment of the logic control circuit is shown in FIGS. 4-6 with the details of operation being shown by the flow charts of FIGS. 7-7C. Referring particularly to FIG. 5, the logic control circuit, and in particular, the printed circuit board 5, will contain on/off switch 35, LEDs 23, controller 29, wireless communication components 47, a manufacturing test switch 39, a configuration setting switch 49 which is set at time of manufacture, SDC memory 31, and a power input connector 51. The various components shown in dot dashed block 53 represent the internal power supply for operating the logic control circuit. It is readily understood that the particular circuit components shown in FIGS. 4 and 5 can vary without affecting the concept of the invention and that one skilled in the art can determine the type and values of these components and the various arrangements thereof to achieve the results described above.

Figure 8:
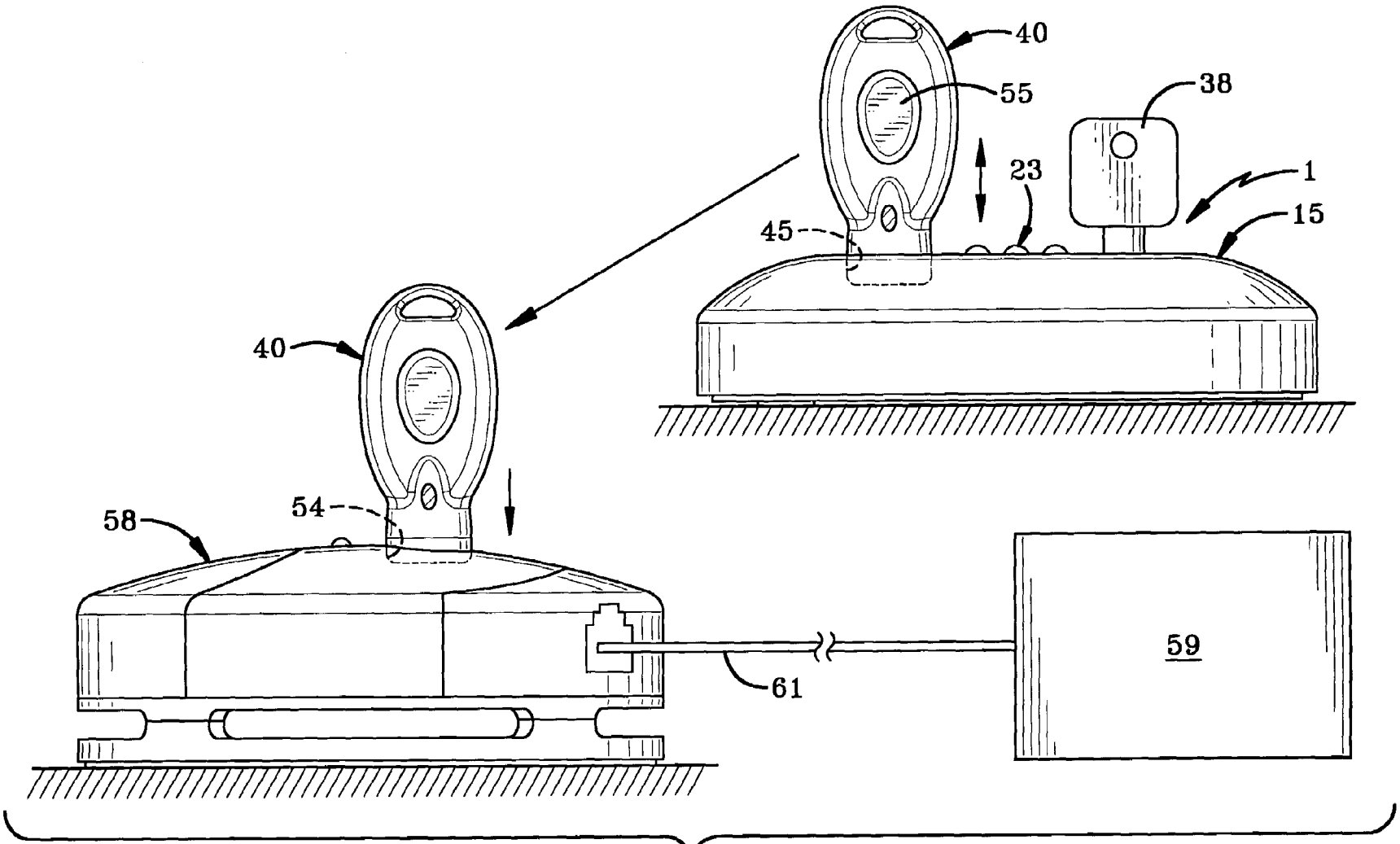
FIG. 8 is a diagrammatic representation of one type of security system in which the programming station of the present invention can be used.

FIG. 8 shows an example of a security system in which programming station 1 will be utilized. The details of such a security system are shown and described in a copending patent application filed concurrently herewith, entitled Security System And Method For Protecting Merchandise. A smart key 40, the details of which are shown and described in a copending patent application filed concurrently herewith, entitled Programmable Key For A Security System For Protecting Merchandise, is initially placed into key receiving port 45. The contents of these two pending patent applications are incorporated herein by reference. After on/off switch 35 has been actuated by use of a key 38, a control switch or push button 55 on key 40 is actuated which actuates the IR wireless communication between key 40 and components 47 of the control logic circuit 7. This will cause a SDC to be generated by controller 29 which is subsequently stored permanently in SDC memory 31. This randomly generated SDC is then stored in key 40 for programming of the code into a security device 58 by placing the key in a key receiving port 54 where it communicates via wireless communication with a logic control circuit of security device 58, as shown in FIG. 8. Security device 58 which may be of the type shown and described in a copending patent application filed concurrently herewith entitled, Programmable Alarm Module And System For Protecting Merchandise, the contents of which are incorporated herein by reference.

Security device 58 may be connected to an item of merchandise 59 by a cable 61, which preferably contains an electrical alarm sense loop which will actuate an alarm within security device 58 if the integrity of cable 61 or its connection with merchandise 59 or security device 58 is compromised. Security device 58 can vary from that shown in FIG. 8 as well as its attachment alarm cable loop 61, without affecting the concept of the invention.

Figures 7, 7C:
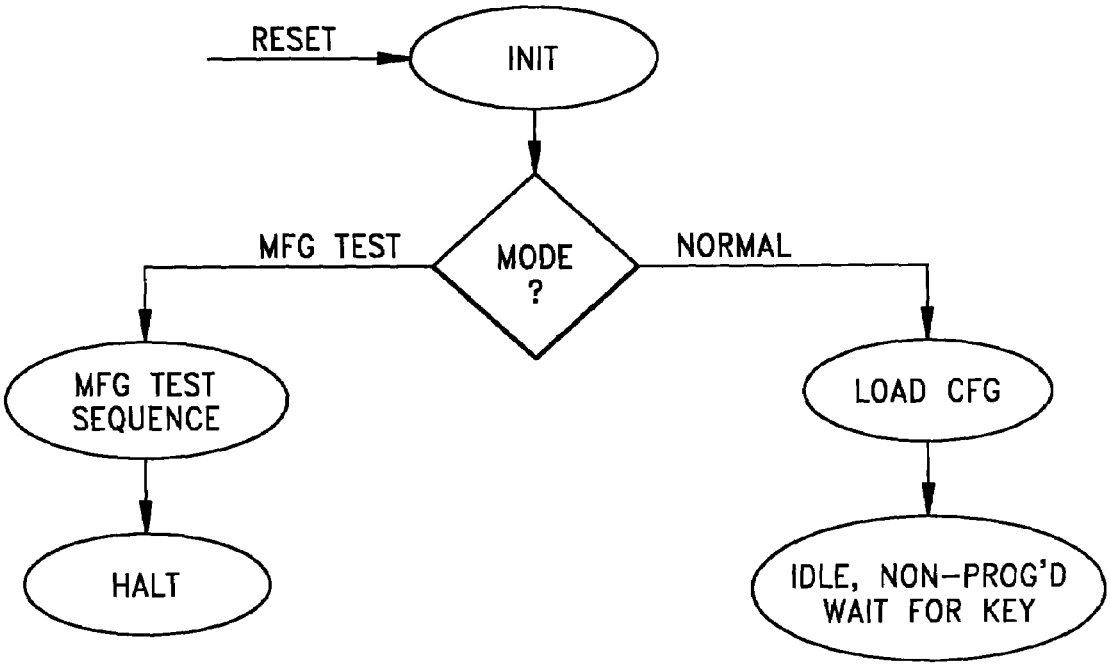
FIGS. 7, 7A and 7B are flow charts showing the manner of operation of the programming station.
FIG. 7C is a list of the abbreviations used in the flow charts of FIGS. 7, 7A and 7B.
Figure 7A:
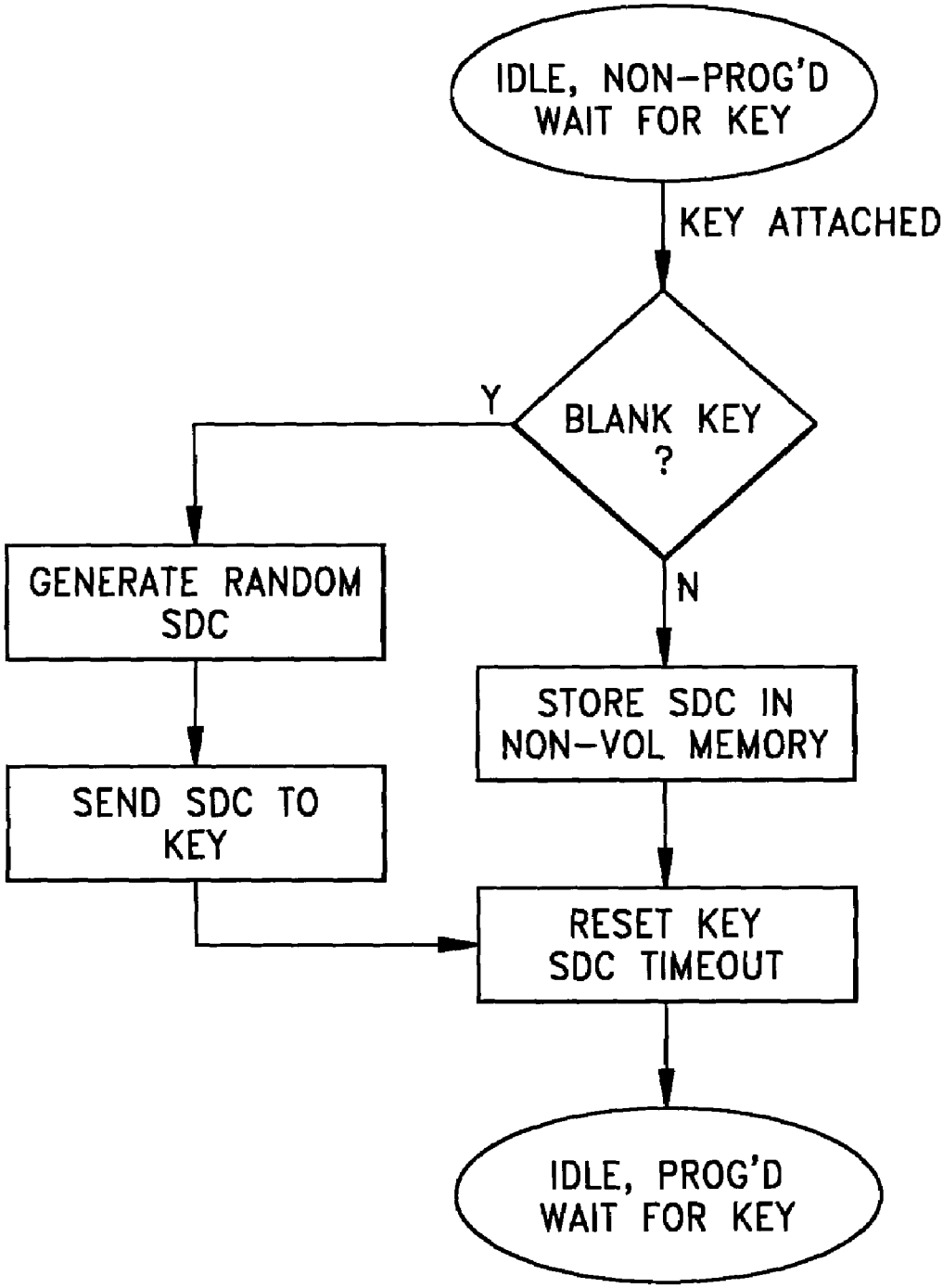
Figure 7B:
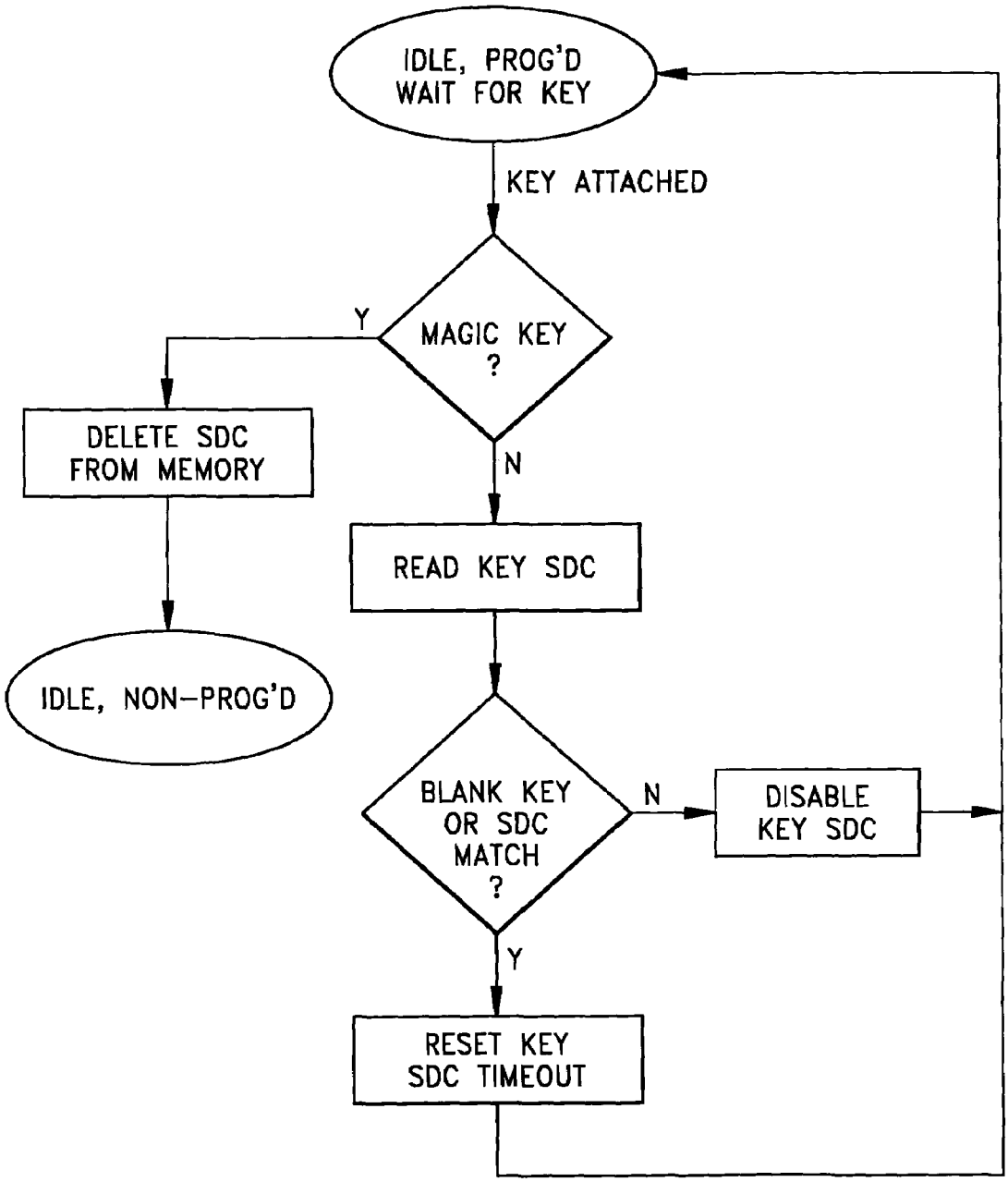

The particular steps that logic control circuit 7 follows when a key 40 is placed in wireless communication with components 47 thereof is shown particularly in FIGS. 7-7C. Also as shown in these flow charts and described in the above-referenced patent application, programming station 1 will reprogram a key 40 when subsequently placed in wireless communication therewith by its location in port 45, to reprogram or refurbish the SDC code provided initially by programming station 1. This SDC preferably is randomly generated the first time that programming station 1 is actuated at a particular retail establishment and used to program a key 40, which SDC then remains permanently in programming station 1 in memory 31 and is used throughout the life thereof for initially programming keys 40 as well as reprogramming the same code into the keys 40 after a timing circuit in the keys has removed the previously programmed SDC therefrom.

Thus, programming station 1 provides for a wireless communication, preferably IR or RF interface, with a smart key 40 for programming the key with an SDC that is initially randomly generated by programming station 1 when first energized and used with the key, which SDC remains in the programming station throughout its life thereby providing the particular retail establishment in which programming station 1 is installed, its own unique security disarm code throughout the life of the security system of the present invention in which programming station 1 is utilized. Preferably, the SDC memory is a non-volatile memory which will survive a power interruption enabling the SDC to always remain the same with the programming station.

LEDs 23 provide a status display when operating the programming station. One of the LEDs indicated at 23A, such as a green LED is an indication that the power is on and the programming station is ready to interface with a smart key 40. The second LED 23B, such as a blue LED, will indicate that an activity occurs such as when programming a key. The third LED 23C, such as a red LED, will indicate programming failure or other problems with the programming station. Again, the number and color of the LEDs and their function could vary without affecting the main concept of the invention, that is, the generation of a SDC unique to a single store, which code remains in the programming station throughout its life and which is used on all smart keys and security devices in the store. Furthermore, the control logic circuit will reprogram the smart keys throughout the key's life preferably with the same SDC for use in operating and disarming security devices such as shown in FIG. 8. Likewise keys 40 will have an internal timer which deactivates the SDC after a preset time period, for example 96 hours, which prevents stolen keys from being reused in the same store after this time period, and never be used at another store even if the SDC has not been deleted since the SDC is unique only to the store using programming station 1.

Furthermore, the logic control circuit of the programming station upon reading an SDC from a smart key different from the unique SDC stored in the programming station will immediately time-out the usable time period in the incorrect key rendering it useless. This prevents a thief from using a programmed key from one store in the programming station of another store.

Although the above description refers to the security code being a disarm code, it is understood that the code can activate and control other functions and features of the security device such as unlocking the device from the product, shutting off an alarm etc. without departing from the concept of the invention. Likewise, the various components of the logic circuit and resulting flow charts can easily be modified by one skilled in the art to achieve the same results. Also, the security code can be preset in programming station 1 at the factory or chosen by the customer, and if desired, be changed later by the customer, also without affecting the concept of the invention.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. An apparatus for generating and retaining a security code for use in a security system for protecting items of merchandise, said apparatus comprising:

a housing;

a logic control circuit located within said housing, said control circuit including:

a) a controller for generating the security code;

b) a memory for storing the generated security code;

c) a wireless communication system for interfacing with a programmable key used for operating a security device attached to an item of merchandise; and d) a visual display for indicating the status of the logic control circuit.

2. The apparatus defined in claim 1 wherein the memory for storing the security code is a non-volatile memory enabling said memory to survive power interruptions.

3. The apparatus defined in claim 1 wherein the visual display includes a plurality of LEDs.

4. The apparatus defined in claim 3 wherein a first of said LEDs is activated when power to the station is ON.

5. The apparatus defined in claim 4 wherein a second of said LEDs flashes for a period of time when wireless communication is started with the programmable key.

6. The apparatus defined in claim 5 wherein a third of said LEDs is activated when a programming failure occurs.

7. The apparatus defined in claim 1 wherein the housing has an internal chamber; and in which the logic control circuit is a printed circuit board located within the housing chamber.

8. The apparatus defined in claim 1 wherein the housing includes a base plate, a main housing shell mounted on the base plate, an internal spacer mounted with the housing shell, and a cover plate mounted over and enclosing said housing shell.

9. The apparatus defined in claim 8 wherein a mechanical fastener secures the base plate to the housing shell.

10. The apparatus defined in claim 8 wherein a mechanical fastener secures the base plate to a supporting structure.

11. The apparatus defined in claim 8 wherein the housing shell is formed of an infrared clear plastic material.

12. The apparatus defined in claim 1 including a mechanical key activated ON/OFF switch mounted in the housing and operatively connected to the logic control circuit.

13. The apparatus defined in claim 1 including a key port formed in the housing for receiving the programmable key therein, said port being proximate the wireless communication system of the control logic circuit.

14. The apparatus defined in claim 1 wherein the security code is a code for disarming the security device.

15. A security system for protecting an object comprising:

a key operated security device for attachment to the object, said security device containing a security code;

a key programmed with the security code to disarm the security device when placed in proximity thereto;

a programming station containing a first communication system for programming the security code into the key, wherein the programming station randomly generates the security code and stores said security code permanently in a security code memory in the programming station;

a second communication system in the key for programming the security code of the key into the security device after the programming station programs the security code into the key and before the key disarms the security device; and a timer in the key for automatically invalidating the security code stored in the key after a predetermined time period.

16. The security system defined in claim 15 wherein the first communication system of the programming station uses infrared (IR) or radio frequency (RF) wavelengths for programming the key with the security code.

17. In combination, a programmable key for operating a security device attached to an item of merchandise and a programming station, said programming station comprising:

a housing;

a logic control circuit located within said housing, said control circuit including a memory for storing a security code and a communication system for transferring the security code to the programmable key used for operating the security device; and a visual display for indicating the status of the logic control circuit of the programming station.

18. The combination defined in claim 17 wherein the control circuit includes a controller for generating the security code.

19. The combination defined in claim 17 wherein the communication system is a wireless communication system.

* * * * *